US006797119B2

(12) United States Patent
Koike

(10) Patent No.: US 6,797,119 B2
(45) Date of Patent: Sep. 28, 2004

(54) PULP PACKING MATERIAL AND METHOD FOR PRODUCING THE SAME

(75) Inventor: Motomu Koike, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/876,851

(22) Filed: Jun. 7, 2001

(65) Prior Publication Data

US 2002/0060004 A1 May 23, 2002

(30) Foreign Application Priority Data

Jul. 19, 2000 (JP) ..... 2000-218215

(51) Int. Cl.[7] ..... D21J 3/00; B33B 29/00; B65D 81/03

(52) U.S. Cl. ..... 162/218; 162/227; 162/231; 162/132; 162/135; 428/34.3

(58) Field of Search ..... 162/135–137, 162/123, 125, 129, 132–133, 9, 157.6, 175, 164.1, 168.1, 179, 218, 219, 221, 222, 224, 226, 227, 231; 427/391–396, 411; 428/34.2, 34.3, 195, 211

(56) References Cited

U.S. PATENT DOCUMENTS

| | | | | | |
|---|---|---|---|---|---|
| 5,366,591 | A | * | 11/1994 | Jewell | 162/9 |
| 5,415,736 | A | * | 5/1995 | Grether | |
| 5,512,333 | A | * | 4/1996 | Suskind | 427/536 |
| 5,654,039 | A | * | 8/1997 | Wenzel et al. | 427/391 |
| 5,667,637 | A | * | 9/1997 | Jewell et al. | 162/146 |
| 5,736,204 | A | * | 4/1998 | Suskind | 428/34.2 |
| 5,837,383 | A | * | 11/1998 | Wenzel et al. | 428/486 |
| 5,840,787 | A | * | 11/1998 | West et al. | 524/35 |
| 5,852,166 | A | * | 12/1998 | Gruber et al. | 528/354 |
| 5,906,894 | A | * | 5/1999 | West et al. | 428/507 |
| 6,133,170 | A | * | 10/2000 | Suenaga et al. | 442/334 |
| 6,174,990 | B1 | * | 1/2001 | Noda | 528/361 |
| 6,197,380 | B1 | * | 3/2001 | Gruber et al. | 427/361 |
| 6,207,278 | B1 | * | 3/2001 | Jewell et al. | 428/393 |

* cited by examiner

*Primary Examiner*—José A. Fortuna
(74) *Attorney, Agent, or Firm*—Ladas & Parry

(57) ABSTRACT

A pulp packing material comprising: a first layer containing crosslinked pulp as a main component; and a second layer containing non-crosslinked pulp or biodegradable plastics as a main component, which are produced by sheet making, wherein the first and second layers are stuck and laminated onto each other.

12 Claims, 7 Drawing Sheets

PULP PACKING MATERIAL AND METHOD FOR PRODUCING THE SAME

BACKGROUND OF THE INVENTION

The present invention relates to a pulp sheet or a pulp molding to be used as a packing material (inclusive of a wrapping material) for a container, a tray, or the like; and to a method for producing such a pulp sheet and a pulp molding.

Heretofore, a foamed material of a synthetic resin such as polystyrene, polyethylene has been much used as a packing material from the point of view of its characteristic such as strength, shock absorbency, proccessability. It is however difficult to incinerate waste of the foamed material from the point of view of the pollution of the environment. Therefore, the foamed material is usually buried as waste in a natural environment. The foamed material however remains for a long term because it has no biodegradability. Hence, there is a problem that the foamed material may spoil a fine sight or pollute the environment.

On the other hand, a pulp sheet, its press molding or a pulp molding, which mainly consists of pulp obtained from waste paper such as newspaper, magazine paper or corrugated board through careful selection for removing foreign substance after maceration with water, can be reused as a pulp raw material if it is macerated with water. Moreover, since it has natural degradability, there is no problem caused by remaining characteristic as in a synthetic resin. For this reason, such a pulp sheet molding or pulp molding has been widely used as a packing material recently.

The packing material composed of the background-art pulp sheet molding or pulp molding was, however, harder less flexible and less shock absorbent than that of the synthetic resin such as polystyrene or polyethylene. Therefore, there was a problem that the article packed in the packing material might be scratched by the packing material during packing, transportation or unpacking.

SUMMARY OF THE INVENTION

The present invention is designed to solve these problems and an object of the present invention is to provide a pulp packing material (inclusive of a pulp sheet and its press molding, and a pulp molding) having little influence on the environment, sufficient hardness to retain its shape, and sufficient flexibility and shock absorbency to avoid injury of an article packed in the packing material.

Another object of the present invention is to provide a pulp packing material having little influence on the environment, sufficient hardness to retain its shape, and sufficient smoothness to avoid injury of an article packed in the packing material.

According to an aspect of the present invention, the pulp packing material comprises a first layer containing crosslinked pulp as a main component, and a second layer made of a non-crosslinked material. Hence, the pulp packing material can be given flexibility and shock absorbency by the crosslinked first layer, and shape retentivity by the non-crosslinked second layer.

In the above pulp packing material, preferably, the second layer may contain pulp or biodegradable plastics as a main component. Hence, the pulp packing material thus obtained is excellent in terms of protection of the environment because it can be degraded by microorganisms or the like even in the case where it is disposed as waste.

Further, in the above pulp packing material, preferably, at least one surface of the pulp packing material may be covered with a film of plastics. Hence, the surface with the film of plastics is smoothened so that the packed article can be hardly injured.

Further, according to another aspect of the present invention, the pulp packing material comprises a sheet containing non-crosslinked pulp as a main component, and a film of plastics that covers at least one surface of the sheet. Hence, shape retentivity is ensured by the non-crosslinked pulp layer. Moreover, the surface with a film of plastics is smoothened so that the packed article can be hardly injured.

According to a further aspect of the present invention, there is provided a method for producing a pulp packing material which comprises the steps of: performing sheet making for producing a first layer containing crosslinked pulp as a main component and a second layer containing non-crosslinked pulp as a main component; and sticking the first and second layers to each other. According to the method, sheets of the first and second layers can be produced respectively by use of a background-art pulp-sheet making apparatus, and then these sheets can be stuck and laminated onto each other. Thus, a packing sheet satisfying the foregoing objects can be provided.

In another method, preferably, a first layer containing crosslinked pulp as a main component and a second layer containing non-crosslinked pulp as a main component are produced in first and second molds, respectively. The first and second layers are cramped between the first and second molds and then, stuck to each other. According to this method, the process from the step of forming the pulp moldings of the respective layers to the step of sticking and laminating the moldings onto each other can be performed continuously by use of the first mold and the second mold having a shape opposed to the shape of the first mold. Hence, a packing molding article satisfying the foregoing objects can be obtained with the advantage of reduction in production time and cost.

According to a further aspect of the present invention, a first layer containing crosslinked pulp as a main component and a second layer containing non-crosslinked pulp as a main component are produced by means of sheet-making respectively, and then the first and second layers are stuck onto each other and press-molded. According to this aspect, sheets of the first and second layers can be produced respectively by use of a conventional pulp-sheet making apparatus. A packing molding article having a predetermined shape and satisfying the foregoing objects can be also obtained from these sheets.

According to a further aspect of the present invention, after at least one surface of a sheet containing non-crosslinked pulp as a main component is covered with a film of plastics, the sheet with the film of plastics is heated. According to this aspect, the surface of the pulp sheet or pulp molding article having shape retentivity can be smoothened.

DETAILED DESCRIPTION OF THE PREFERRED EMBODIMENTS

Embodiment 1

Figure 1:
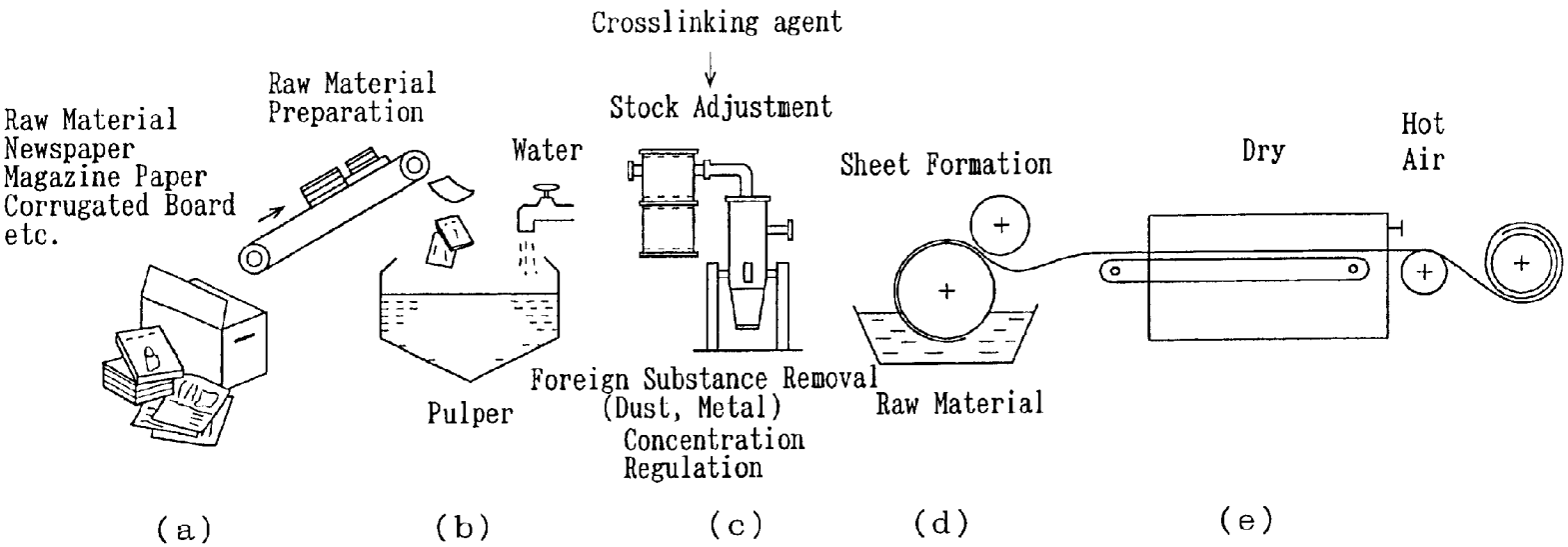
FIG. 1 shows various views for explaining a method for producing a pulp sheet according to Embodiment 1 of the present invention.
Figure 2:
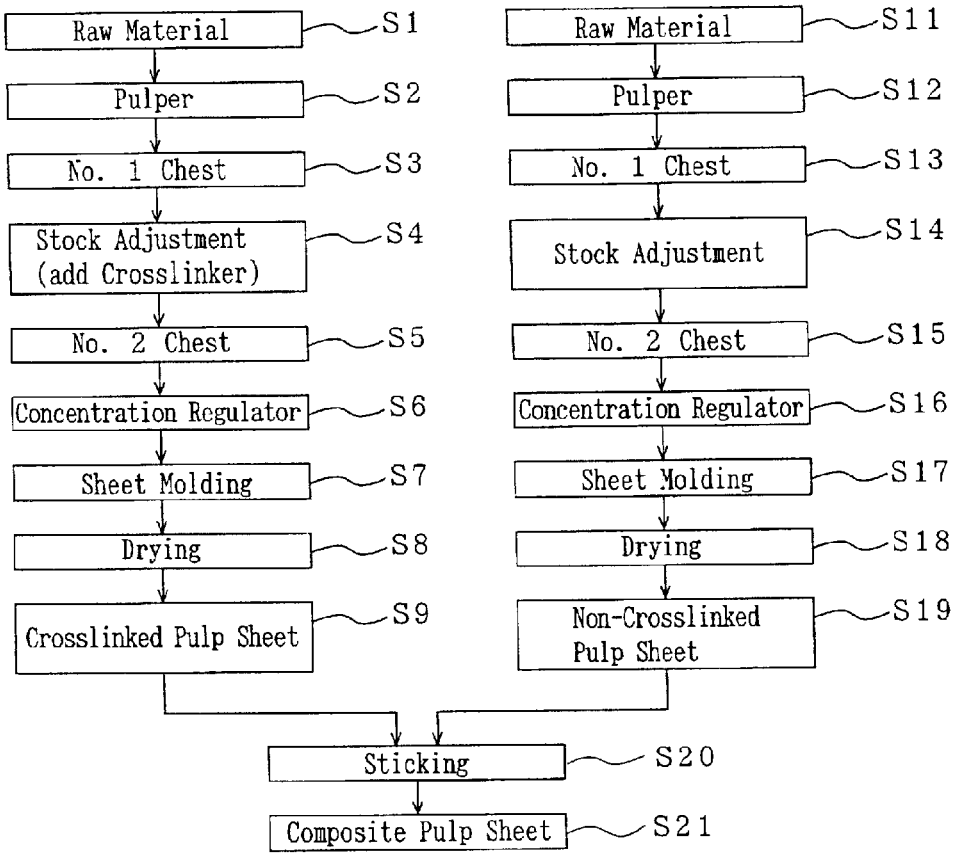
FIG. 2 is a flow chart for explaining the producing method depicted in FIG. 1.

FIG. 1 shows various views for explaining a method for producing a pulp sheet according to Embodiment 1 of the present invention. FIG. 2 is a flow chart of the producing method.

First, waste paper (pulp) such as newspaper, magazine paper or corrugated board, which is a raw material, is put in a pulper and supplied with water so as to be macerated and dispersed into the water ((a) and (b) in FIG. 1; S1–S2 in FIG. 2). Then, the macerated and dispersed raw material is reserved in No. 1 chest. The raw material is gradually supplied into a stock adjuster. In the stock adjuster, unmacerated part of the raw material is further macerated while iron pieces and foreign substances are removed. Moreover, in the stock adjuster, a crosslinking agent such as epichlorohydrin is added to the raw material so that pulp fiber of the raw material is subjected to a crosslinking reaction. The raw material thus adjusted is reserved in No. 2 chest. The raw material is gradually supplied into a concentration regulator. In the concentration regulator, the concentration of the raw material is regulated ((c) in FIG. 1; S3–S6 in FIG. 2). Then, a pulp sheet is formed from the thus prepared raw material by use of a sheet making machine provided to make a sheet ((d) in FIG. 1; S7 in FIG. 2). The pulp sheet is dried so that a crosslinked pulp sheet for a first layer is produced ((e) in FIG. 1; S8–S9 in FIG. 2).

On the other hand, a non-crosslinked pulp sheet for a second layer is produced from waste paper such as newspaper, magazine paper or corrugated board, which is a raw material, in the same manner as described above except the addition of such a crosslinking agent (S11–S19 in FIG. 2).

Figure 3:
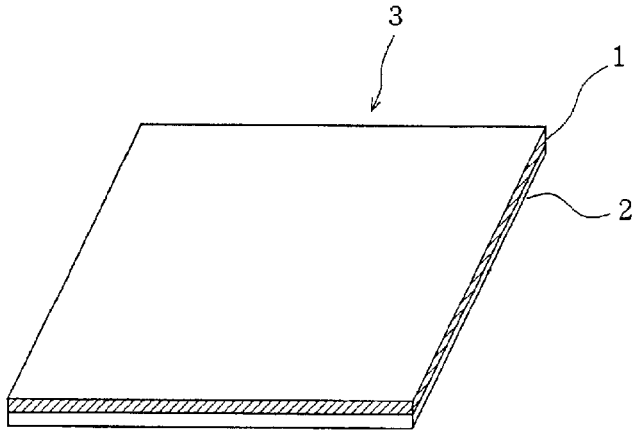
FIG. 3 is a perspective view of a composite pulp sheet produced by the producing method depicted in FIG. 1.

The thus produced pulp sheets 1 and 2 for first and second layers are stuck and laminated onto each other by means of contact bonding or by use of an adhesive agent, or the like (S20 in FIG. 2), so that a composite pulp sheet 3 as shown in FIG. 3 is produced (S21 in FIG. 2).

The composite pulp sheet 3 is given flexibility by the crosslinked layer and shape retentivity by the non-crosslinked layer, so that various kinds of wrapping or packaging materials such as containers, trays, etc. can be produced, taking advantage of these characteristics. Moreover, there is no problem as in synthetic resin articles even in the case when the composite pulp sheet 3 is disposed as waste because the composite pulp sheet 3 contains pulp as a main component.

Alternatively, a pulp sheet made of crosslinked pulp as a main component in the aforementioned manner and a plastic sheet formed of biodegradable plastics as a main component may be used as first and second layers respectively, and stuck and laminated onto each other by means of contact bonding or by use of an adhesive agent, or the like. Also in this case, the same effect as described above can be obtained in the form of various kinds of wrapping or packaging materials. The biodegradable plastics are degraded so as to return to nature even in the case where the biodegradable plastics are disposed as waste in the natural environment, so that there is no problem as in synthetic resin articles.

Three types of plastics are known as the biodegradable plastics. That is, they are: natural polymer type plastics using polysaccharide such as starch, cellulose or chitin; microbiogenetic polyester type plastics using polyester produced by microorganisms such as hydrogen bacteria or blue algae; and chemical synthesis type plastics using synthetic macromolecules, for example, aliphatic polyester such as polylactate, polycaprolactone, or the like.

Embodiment 2

Figure 4:
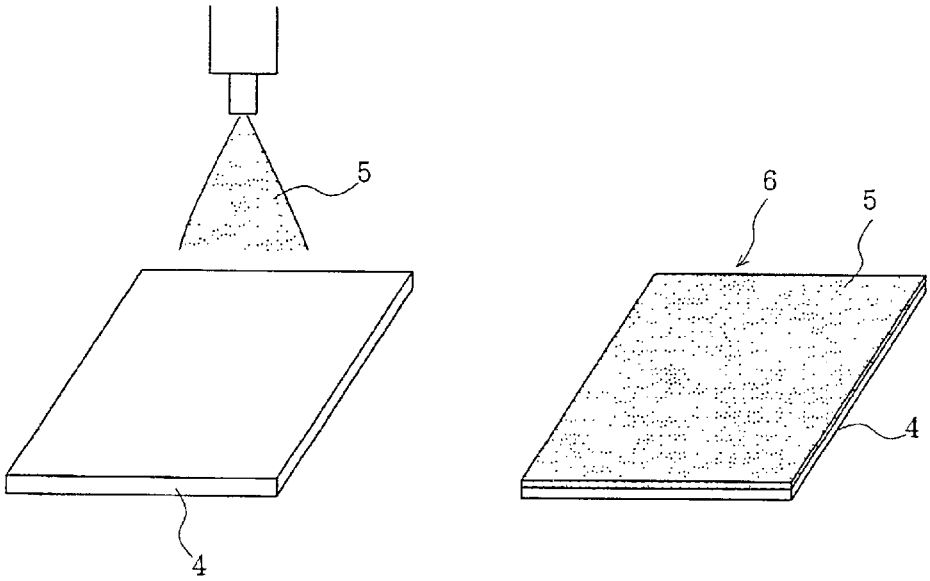
FIG. 4 is a view explaining a method for producing a pulp sheet according to Embodiment 2 of the present invention.

FIG. 4 is a view for explaining a method for producing a pulp sheet according to Embodiment 2 of the present invention. In this embodiment, a composite pulp sheet 6 is produced as follows. Powder of plastics 5 such as PET (polyethylene terephthalate) or the aforementioned biodegradable plastics is sprayed so as to be applied onto one surface or both surfaces of a pulp sheet 4 containing non-crosslinked waste paper (pulp) as a main component. Then, the pulp sheet 4 thus coated with the powder of plastics 5 is heated to thereby integrate the pulp sheet 4 with the plastics 5 to obtain the composite pulp sheet 6.

The composite pulp sheet 6 thus produced is given shape retentivity by the non-crosslinked pulp sheet though the composite pulp sheet 6 has not high shock absorbency. The surface smoothness of the plastics applied on the non-crosslinked pulp sheet prevents a packed article from being injured and prevents dust or dirt from being deposited on the packed article. Hence, the composite pulp sheet 6 can be used as a wrapping or packaging material when there is no fear of intensive shock, or the like.

Incidentally, the coating of plastics may be replaced by lamination of a plastic thin layer.

Also in the case where the aforementioned coating or lamination of plastics is adapted to the composite pulp sheet produced as described above in Embodiment 1 so that the composite pulp sheet is covered with a film, the same effect as described above can be obtained.

Embodiment 3

Figure 5:
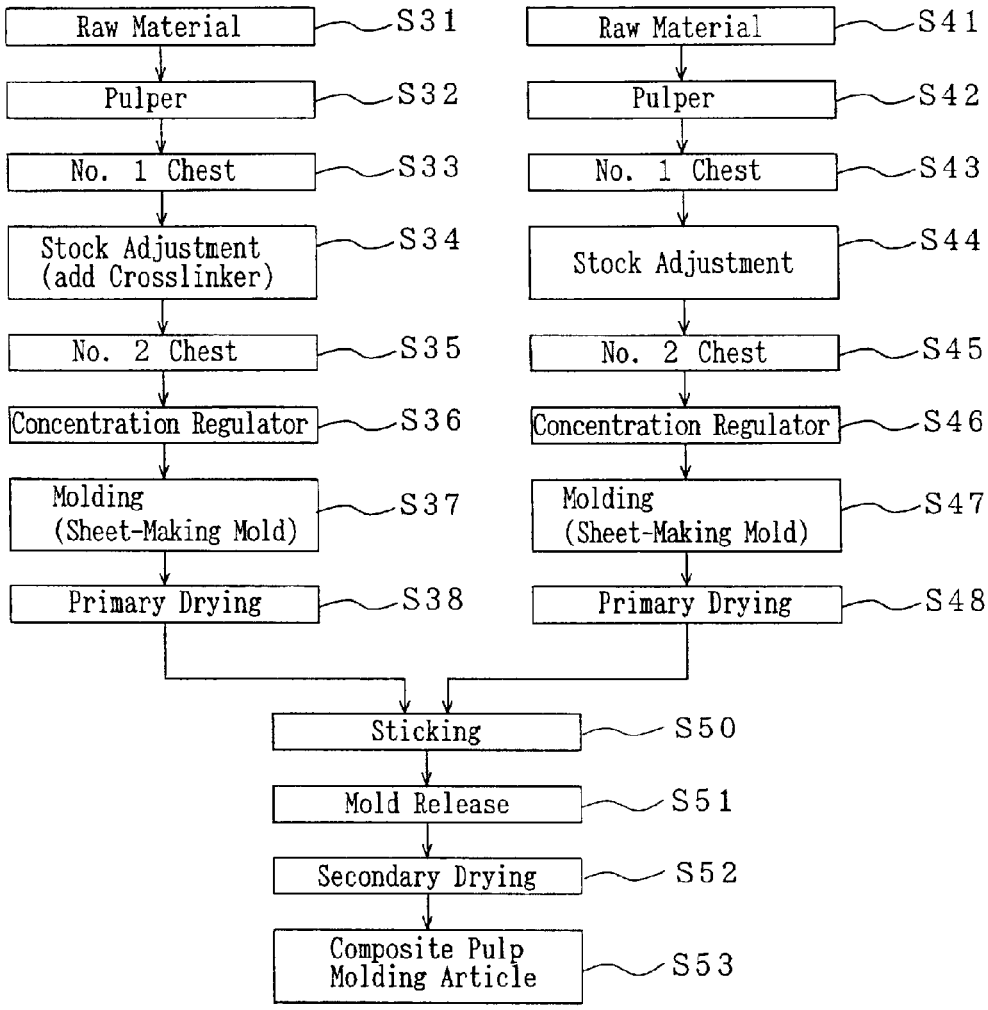
FIG. 5 is a flow chart for explaining a method for producing a composite pulp molding article according to Embodiment 3 of the present invention.

FIG. 5 is a flowchart showing a method for producing a composite pulp molding article according to Embodiment 3 of the present invention.

In this method, first, waste paper (pulp) such as newspaper, magazine paper or corrugated board, which is a raw material, is put in a pulper and supplied with water so as to be macerated and dispersed into the water (S31–S32 in FIG. 5). Then, the macerated and dispersed raw material is reserved in No. 1 chest (S33 in FIG. 5). The raw material is gradually supplied into a stock adjuster. In the stock adjuster, unmacerated part of the raw material is further macerated while iron pieces and foreign substances are removed. Moreover, in the stock adjuster, a crosslinking agent such as epichlorohydrin is added to the raw material so that pulp fiber of the raw material is subjected to a crosslinking reaction (S34 in FIG. 5). The raw material thus adjusted is reserved in No. 2 chest (S35 in FIG. 5). The raw material is gradually supplied into a concentration regulator. In the concentration regulator, the concentration of the raw material is regulated (S36 in FIG. 5). Then, the raw material is taken by suction or the like into a first mold (sheet-making mold) formed to obtain a predetermined shape so that a pulp molding for a first layer is formed (S37 in FIG. 5). The pulp molding is primarily dried while it is held in this sheet-making mold (S38 in FIG. 5).

On the other hand, a pulp molding for a second layer is produced from waste paper such as newspaper, magazine paper or corrugated board, which is a raw material, and primarily dried in the same process as described above except that the crosslinking agent is not added to the raw material and a second mold (sheet-making mold) having a shape opposed to that of the first mold is used in place of the first mold (S41–S48 in FIG. 5).

Figure 6A:
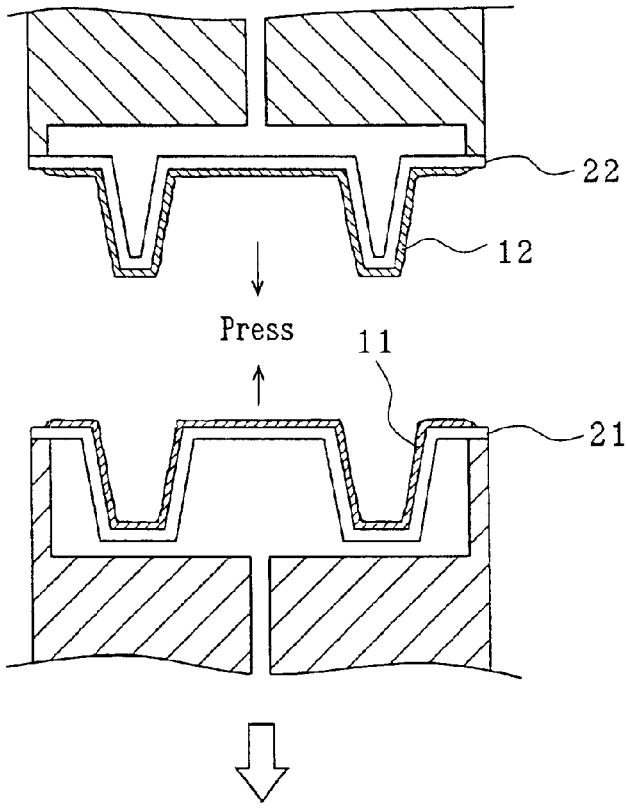
FIGS. 6A and 6B are step views showing the work using a first mold and a second mold in the producing method depicted in FIG. 5.
Figure 6B:
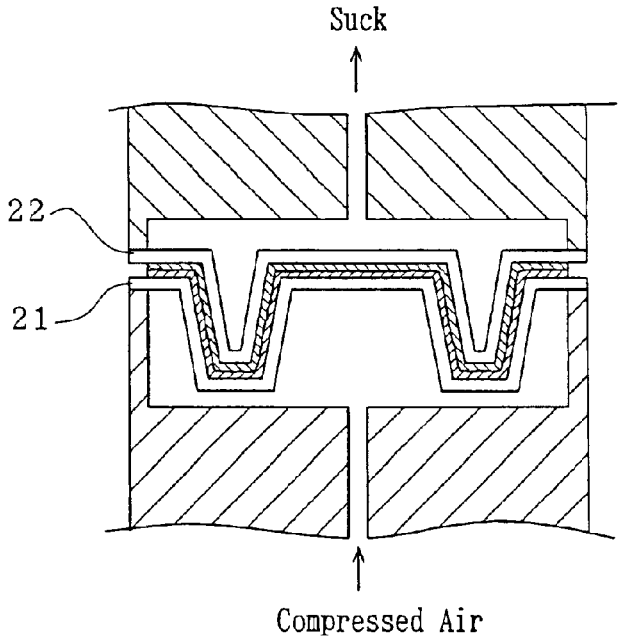

Then, as shown in FIGS. 6A and 6B, the first mold 21 holding the pulp molding 11 for the first layer and the second mold 22 holding the pulp molding 12 for the second layer are pressed against each other so that the shapes of the pulp moldings are fitted to each other. These pulp moldings are stuck and laminated on each other by means of contact bonding or by use of an adhesive agent, or the like (FIGS. 6A and 6B; S50 in FIG. 5). Then, while compressed air is fed to the first mold 21, sucking force is given to the second mold 22 so that the first mold 21 is separated from the composite pulp molding article made of a laminate of the first and second layers (FIG. 6B; S51 in FIG. 5).

Figure 7:
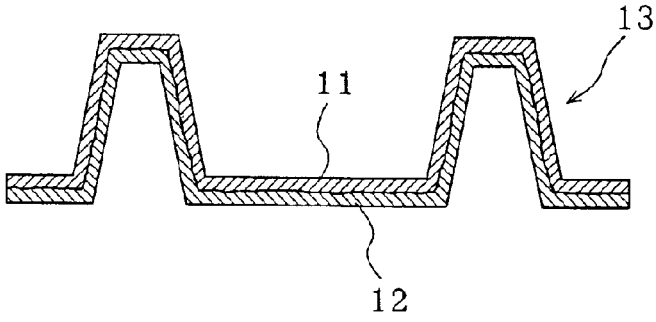
FIG. 7 is a sectional view of a composite pulp molding article produced by the producing method depicted in FIG. 5.

Compressed air is further fed to the second mold 22 so that the composite pulp molding article held in the second mold 22 is dropped onto a drier and secondarily dried (S52 in FIG. 5). Thus, a composite pulp molding article 13 as shown in FIG. 7 is produced (S53 in FIG. 5).

The composite pulp molding article 13 thus produced is given flexibility by the crosslinked first layer pulp molding 11 and shape retentivity by the non-crosslinked second layer pulp molding 12. Hence, by using molds having a desired shape, a desired container or tray can be obtained. Moreover, there is no problem as that in synthetic resin articles even in the case when the composite pulp molding article 13 is disposed as waste, because the composite pulp molding article 13 contains pulp as a main component.

Although this embodiment has shown the case where crosslinked pulp is molded in the first mold and non-crosslinked pulp is molded in the second mold, the present invention may be applied also to the case where the molds are used reversely.

Alternatively, a pulp sheet made of crosslinked pulp as a main component in the aforementioned manner and a plastic molding formed of the aforementioned biodegradable plastics as a main component may be used for first and second layers respectively. Also in this case, the same effect as described above can be obtained in the form of various kinds of wrapping or packaging materials when the first and second layers are stuck and laminated onto each other by means of thermal contact bonding or by use of an adhesive agent, or the like.

Embodiment 4

Press molding may be used to mold the composite pulp sheet, which is produced in Embodiment 1 and made of a laminate of the crosslinked first layer and the non-crosslinked second layer, into a predetermined shape in accordance with a shape of a packed article. That is, if a press mold is arranged to obtain a desired shape, a wrapping or packaging material, such as a container or a tray, having a desired shape can be obtained by the press molding of the composite pulp sheet.

Incidentally, before the crosslinked first layer and the non-crosslinked second layer produced in Embodiment 1 are stuck to each other, the respective first and second layers may be pressed into predetermined shapes individually and then laminated onto each other by means of contact bonding or by use of an adhesive agent.

Figure 8:
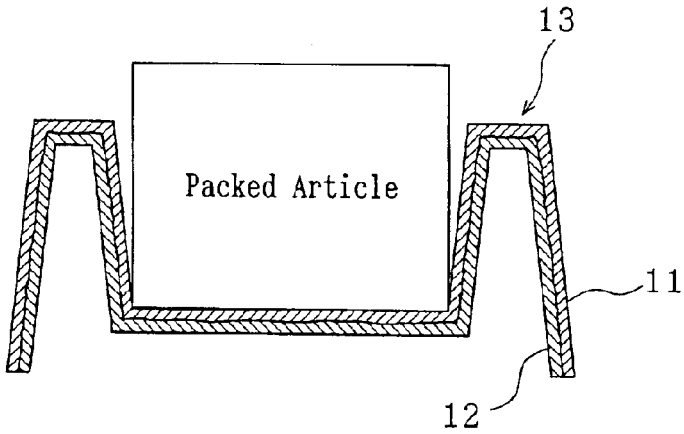
FIG. 8 is a view showing an example of use of the composite pulp molding article produced in Embodiment 3 or 4.

FIG. 8 shows an example of use of the pulp molding article obtained in Embodiment 3 or 4. In this example, the composite pulp molding article 13 is used such that the crosslinked first layer pulp molding 11 is positioned inside so as to come into contact with a packed article while the non-crosslinked second layer pulp molding 12 is positioned outside. In this manner, the crosslinked first layer absorbs shock without scratching the packed article and, at the same time, the non-crosslinked second layer functions as a base for retaining the shape of the packed article.

Embodiment 5

Figure 9:
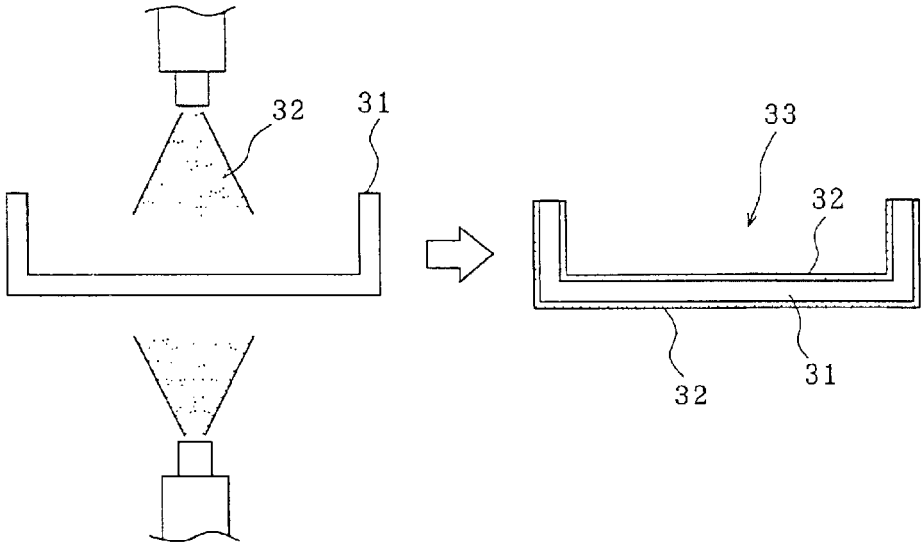
FIG. 9 is a view for explaining a method for producing a pulp molding according to Embodiment 5 of the present invention.

FIG. 9 is a view for explaining a method for producing a composite pulp molding article according to Embodiment 5 of the present invention. As shown in FIG. 9, one surface or both surfaces of a pulp molding 31 containing non-crosslinked pulp as a main component are sprayed and coated with powder of plastics 32 such as PET (polyethylene terephthalate) or the aforementioned biodegradable plastics, and then heated so that the pulp molding 31 is integrated with the plastics 32. Thus, a composite pulp molding article 33 is produced.

Figure 10:
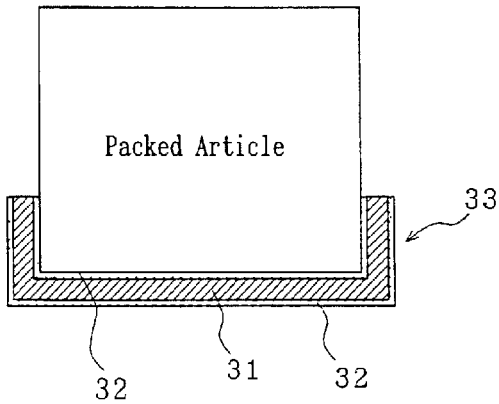
FIG. 10 is a view showing an example of use of the pulp molding produced in Embodiment 5.

The composite pulp molding article 33 thus produced is given shape retentivity by the non-crosslinked pulp molding though the composite pulp molding article 33 has not high shock absorbency. The surface smoothness of the plastics applied on the non-crosslinked pulp molding prevents a packed article from being injured and prevents dust or dirt from being deposited on the packed article. Hence, the composite pulp molding article 33 can be used as a container or tray when there is no fear of intensive shock, or the like. For example, the composite pulp molding article 33 can be used as shown in FIG. 10.

Incidentally, coating of plastics may be replaced by lamination of a plastic thin layer.

Also in the case where the aforementioned coating or lamination of plastics is adapted to the composite pulp molding article produced as described above in Embodiment 3 or 4 to cover its surface with a film, the same effect as described above can be obtained.

Incidentally, a suitable layer may be inserted as an intermediate layer into the composite pulp sheet or composite pulp molding article described above in the aforementioned embodiments so that the number of layers contained in the composite pulp sheet or composite pulp molding article is increased depending on the purpose of its use.

When an adhesive agent is used for sticking these layers to one another, an adhesive agent having a suitable adhesive strength is to be selected in consideration of reduction of time and labor in taking the layers apart someday.

Although the aforementioned embodiments have shown the case where waste paper pulp is used as a pulp raw material, it is a matter +of course that the raw material is not always limited thereto and that any other pulp such as wood pulp used heretofore can be used as the raw material.

I claim:

1. A composite pulp molding container for packing comprising:

a pulp packing material including a first layer containing crosslinked pulp as a main component and a second layer containing a non-crosslinked material as a main component, wherein said pulp packing material is molded into a shape such that said first layer constitutes an inner surface which contacts with an article to be packed in said container and said second layer constitutes an outer surface of said container.

2. A composite pulp molding container for packing according to claim 1, wherein said second layer contains pulp or biodegradable plastics as a main component.

3. The composite pulp molding container for packing according to claim 2, wherein at least one surface of said packing material is covered with a film of plastics.

4. The composite pulp molding container for packing according to claim 1, wherein at least one surface of said packing material is covered with a film of plastics.

5. A method for producing a composite pulp molding container for packing, comprising the steps of:

producing a first layer containing crosslinked pulp as a main component and having a shape such that said first layer constitutes an inner surface that contacts with an article to be packed in said container on a first mold;

producing a second layer containing non-crosslinked pulp as a main component and having a shape such that said second layer constitutes an outer surface of said container on a second mold; and sticking said first and second layers to each other while being cramped between said first and second molds to complete said container.

6. The method for producing a composite pulp molding container for packing according to claim 5 further comprising the step of forming a film of plastics covering said inner surface and/or said outer surface.

7. A method for producing a composite pulp molding container for packing comprising the steps of:

producing a first layer containing crosslinked pulp as a main component;

producing a second layer containing non-crosslinked material as a main component;

forming a pulp packing material by sticking said first and second layers to each other; and molding the pulp packing material into a shape such that said first layer constitutes an inner surface which contacts with an article to be packed in said container and said second layer constitutes an outer surface of said container by press molding.

8. The method for producing a composite pulp molding container for packing according to claim 7, further comprising the step of fanning a film of plastics covering said inner surface and/or said outer surface.

9. A method for producing a composite pulp molding container for packing comprising the steps of:

producing a first layer containing crosslinked pulp as a main component and being molded into a shape such that said first layer constitutes an inner surface that contacts with an article to be packed in said container in a first mold;

producing a second layer of biodegradable plastic, molded into a shape such that said second layer constitutes an outer surface of said container in a second mold; and sticking said molded first and second layers to each other to complete said container.

10. The method for producing a composite pulp molding container for packing according to claim 9, further comprising the step of forming a film of plastics covering said inner surface and/or said outer surface.

11. A method for producing a composite pulp molding container for packing comprising the steps of:

producing a first layer containing crosslinked pulp as a main component;

molding the first layer into a shape such that said first layer constitutes an inner surface which contacts with an article to be packed in said container by press molding;

producing a second layer containing non-crosslinked material as a main component;

molding the second layer into a shape such that said second layer constitutes an outer surface of said container by press molding; and sticking said press molded first and second layers to each other to complete said container.

12. The method for producing a composite pulp molding container for packing according to claim 11, further comprising the step of forming a film of plastics covering said inner surface and/or said outer surface.

* * * * *